United States Patent [19]

Kurisu et al.

[11] Patent Number: 4,547,788

[45] Date of Patent: Oct. 15, 1985

[54] THERMOSENSITIVE IMAGE TRANSFER MEDIUM

[75] Inventors: Norio Kurisu, Numazu; Keishi Kubo, Yokohama, both of Japan

[73] Assignee: Ricoh Company, Ltd., Tokyo, Japan

[21] Appl. No.: 516,180

[22] Filed: Jul. 21, 1983

[30] Foreign Application Priority Data

Aug. 11, 1982 [JP] Japan ..... 57-139347

[51] Int. Cl.[4] ..... B41M 5/22

[52] U.S. Cl. ..... 346/208; 346/200; 346/201; 346/207; 346/209; 346/212; 346/216; 346/225

[58] Field of Search ..... 346/207-209, 346/216, 217, 225, 200, 201, 212, 226; 427/150, 151

[56] References Cited

U.S. PATENT DOCUMENTS 4,355,070 10/1982 Oeda ..... 428/328

FOREIGN PATENT DOCUMENTS 0118059 10/1978 Japan ..... 346/207
0023545 2/1979 Japan ..... 346/207
6169087 12/1981 Japan ..... 346/207

*Primary Examiner*—Bruce H. Ness
*Attorney, Agent, or Firm*—Flynn, Thiel, Boutell & Tanis

[57] ABSTRACT

A thermosensitive image transfer medium comprising: (a) an image transfer sheet having an image transfer layer comprising a leuco dye; and (b) an acceptor sheet having an acceptor layer comprising a coloring agent which induces color formation in the leuco dye, and, of the image transfer layer and the acceptor layer, at least the image transfer layer further containing a porous filler having an oil absorption of 50 ml/100 g or more as measured in accordance with the Japanese Industrial Standard K 5101.

22 Claims, No Drawings

THERMOSENSITIVE IMAGE TRANSFER MEDIUM

BACKGROUND OF THE INVENTION

The present invention relates to a thermosensitive image transfer medium which is capable of yielding images with high and uniform image density even if image transfer is done multiple times.

Conventionally, there are known several thermosensitive image transfer mediums. For example, a thermosensitive image transfer medium consisting of (i) an image transfer sheet comprising a thermal-sublimation-type dye layer formed on a support material and (ii) an acceptor sheet capable of accepting the sublimated dye images from the thermal-sublimation-type dye layer of the image transfer sheet when thermal printing is performed from the backside of the image transfer sheet.

Another conventional thermosensitive image transfer medium consists of (i) an image transfer sheet comprising an image transfer layer formed on a support material, which image transfer layer comprises a thermo-fusible material and a pigment or a dye, and (ii) an acceptor sheet.

The former thermosensitive image transfer material has the shortcomings that the dye images on the acceptor sheet are poor in preservability because of the use of the thermal-sublimation-type dye and, therefore an overcoating must be provided on the transferred images.

In the case of the latter thermosensitive image transfer medium, the image transfer layer contains a pigment or a dye dispersed in the thermo-fusible material. In this thermosensitive image transfer medium, if a large quantity of the pigment is contained in the image transfer layer in an attempt of obtaining images with high density, the image transfer ratio decreases, and the result is that it becomes difficult to obtain images with high density, and if a large quantity of the thermo-fusible material is contained in the image transfer layer in order to increase the thermosensitivity, a large quantity of the thermo-fusible material is transferred from the transfer sheet to the acceptor sheet and, as a result, it becomes difficult to peel the transfer sheet off the acceptor sheet smoothly, and line images on the acceptor sheet become unclear.

In addition to the above-described conventional thermosensitive image transfer mediums, a further thermal printing type thermosensitive image transfer medium is known, in which materials which react with each other to form a color upon application of heat thereto are supported separately in the form of two layers, each layer on a different support material, and thermal printing is performed by bringing the two layers of containing those materials into close contact with each other. In thermosensitive image transfer mediums of this type, the coloring reaction does not occur sufficiently if the image transfer layer is merely transferred to the acceptor layer by bringing them into contact with each other, thus yielding images with low image density. If thermal printing were performed at high temperatures, with application of heat for a long period of time, for allowing the coloring reaction to take place sufficiently, images with high density would be obtained on the acceptor sheet. However, the coloring reaction would also take place on the image transfer sheet at the same time.

In other words, image formation occurs on both the acceptor sheet and the image transfer sheet.

SUMMARY OF THE INVENTION

It is therefore an object of the present invention to provide a thermosensitive image transfer medium with higher sensitivity capable of yielding images with higher image density, in comparison with the above-described conventional thermosensitive image transfer mediums, which thermosensitive image transfer medium according to the present invention can provide images with uniform image density even if it is used for multiple image transfers, with a small amount of leuco dye components being transferred from the image transfer layer to the acceptor layer of the medium in each image transfer step.

This object of the present invention can be attained by a thermosensitive image transfer medium consisting of (i) an image transfer sheet having an image transfer layer consisting essentially of a leuco dye, and (ii) an acceptor sheet having an acceptor layer consisting essentially of a coloring agent which induces color formation in the leuco dye, and of the image transfer layer and the acceptor layer, at least the image transfer layer containing a porous filler having an oil absorption of 50 ml/100 g or more as measured in accordance with the Japanese Industrial Standard K 5101.

DETAILED DESCRIPTION OF THE PREFERRED EMBODIMENTS

The thermosensitive image transfer medium according to the present invention consists of a transfer sheet having a image transfer layer comprising as the main component a leuco dye and an acceptor sheet having an acceptor layer comprising as the main component a coloring agent which induces color formation in the leuco dye, with a porous filler with an oil absorption of 50 ml/100 g or more further contained at least in the image transfer layer in an amount ranging, preferably, from 0.01 part by weight to 1 part by weight with respect to 1 part by weight of the leuco dye.

In the thermosensitive image transfer medium according to the present invention, image formation is performed by superimposing the acceptor sheet on the image transfer sheet in such a manner that the acceptor layer of the acceptor sheet comes into contact with the image transfer layer of the image transfer sheet, and thermal printing is performed from the backside of the image transfer sheet or from the backside of the acceptor sheet, whereby images can be formed on the surface of the acceptor layer of the acceptor sheet.

In the present invention, as described previously, since the porous filler with the particular oil absorption is contained at least in the image transfer layer of the image transfer sheet, the dye components can be transferred uniformly from the image transfer layer to the acceptor layer, while a large quantity of the dye is retained within the image transfer layer during the image transfer steps. At each image transfer step, a small amount of the dye is transported from the image transfer layer to the acceptor layer. Thus, the same image transfer sheet can be used many times in the present invention with formation of the colored images with uniform density on each acceptor sheet.

The porous filler for use in the present invention has an oil absorption of at least 50 ml/100 g, preferably 150 ml/100 g or more, (which is measured in accordance with the Japanese Industial Standard K 5101 method).

When the oil absorption is less than 50 ml/100 g, the object of the present invention cannot be attained. The amount of the porous filler contained in the image transfer layer is in the range of 0.1 part by weight to 1 part by weight, preferably in the range of 0.03 parts by weight to 0.5 parts by weight, with respect to 1 part by weight of the leuco dye.

In the present invention, the porous filler with the oil absorption of 50 ml/100 g or more can also be contained in the acceptor layer, but this can be omitted when unnecessary. When the porous filler is contained in the acceptor layer, the amount of the filler is in range of 0.01 part by weight or more, usually in the range of 0.05 parts by weight to 10 parts by weight, preferably in the range 0.1 part by weight to 3 parts by weight, with respect to 1 part by weight of the coloring agent.

Specific examples of the porous filler for use in the present invention are organic or inorganic powder of silica, aluminum silicate, alumina, aluminum hydroxide, magnesium hydroxide, urea-formaldehyde resin and styrene resin.

The image transfer sheet for use in the present invention comprises (i) a support material made of, for example, paper, synthetic paper, plastic film, and (ii) the image transfer layer consisting essentially of the leuco dye formed on the support material. The image transfer layer further contains the above-mentioned porous filler as an auxiliary component.

As the leuco dye for use in the image transfer layer, conventional leuco dyes for use in pressure-sensitive paper and heat-sensitive paper can be employed, for example, triphenylmethane-type, fluoran-type, phenothiazine-type, auramine-type and spiropyran-type leuco dyes.

Specific examples of these leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide
3-cyclohexylamino-6-chlorofluoran,
3-(N,N-diethylamino)-5-methyl-7-(N,N-dibenzylamino)fluoran,
3-dimethylamino-5,7-dimethylfluoran,
3-diethylamino-7-methylfluoran,
3-diethylamino-7,8-benzfluoran,
3-diethylamino-6-methyl-7-chlorofluoran,
3-pyrrolidino-6-methyl-7-anilinofluoran,
2-{N-(3'-trifluoromethylphenyl)amino}-6-diethylaminofluoran,
2-{3,6-bis(diethylamino)-9-(o-chloroanilino)xanthylbenzoic acid lactam},
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-(2-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide, and
3-(2'-methoxy-4'-dimethylaminophenyl)-3-(2'-hydroxy-4'-chloro-5'-methylphenyl)phthalide.

In the present invention, the leuco dye is used usually in an amount ranging from 0.3 g to 30 g, preferably in the range of about 0.5 g to about 20 g, with respect to 1 $m^2$ of the support material.

The acceptor sheet for use in the present invention consists of a support material made of, for example, paper, synthetic paper or plastic film, and the acceptor layer formed on the support material, which contains a coloring agent which colors the leuco dye. As the coloring agent, electron acceptor materials, for instance, phenolic materials, organic acid, salts thereof or ester thereof can be employed. For practical use, coloring agents with a melting point not higher than 200° C. are preferable.

Specific examples of the coloring agents for use in the present invention are as follows:

| | Melting Point (°C.) |
|---|---|
| 4-tert-butylphenol | 98 |
| 4-hydroxydiphenyl ether | 84 |
| 1-naphthol | 98 |
| 2-naphthol | 121 |
| methyl-4-hydroxybenzoate | 131 |
| 4-hydroxyacetophenone | 109 |
| 2,2'-dihydroxydiphenyl ether | 79 |
| 4-phenylphenol | 166 |
| 4-tert-octylcatechol | 109 |
| 2,2'-dihydroxydiphenyl | 103 |
| 4,4'-methylenebisphenol | 160 |
| 2,2'-methylenebis (4-chlorophenol) | 164 |
| 2,2'-methylenebis(4-methyl-6-tert-butylphenol) | 125 |
| 4,4'-isopropylidenediphenol | 156 |
| 4,4'-isopropylidenebis(2-chlorophenol) | 90 |
| 4,4'-isopropylidenebis(2,6-dibromophenol) | 172 |
| 4,4'-isopropylidenebis(2-tert-butylphenol) | 110 |
| 4,4'-isopropylidenebis(2-methylphenol) | 136 |
| 4,4'-isopropylidenebis(2,6-dimethylphenol) | 168 |
| 4,4'-sec-butylidenediphenol | 119 |
| 4,4'-sec-butylidenebis(2-methylphenol) | 142 |
| 4,4'-cyclohexylidenediphenol | 180 |
| 4,4'-cyclohexylidenebis(2-methylphenol) | 184 |
| salicylic acid | 163 |
| salicylic acid m-tolyl ester | 74 |
| salicylic acid phenacyl ester | 110 |
| 4-hydroxybenzoic acid methyl ester | 131 |
| 4-hydroxybenzoic acid ethyl ester | 116 |
| 4-hydroxybenzoic acid propyl ester | 98 |
| 4-hydroxybenzoic acid isopropyl ester | 86 |
| 4-hydroxybenzoic acid butyl ester | 71 |
| 4-hydroxybenzoic acid isoamyl ester | 50 |
| 4-hydroxybenzoic acid phenyl ester | 178 |
| 4-hydroxybenzoic acid benzyl ester | 111 |
| 4-hydroxybenzoic acid cyclohexyl ester | 119 |
| 5-hydroxysalicylic acid | 200 |
| 5-chlorosalicylic acid | 172 |
| 3-chlorosalicylic acid | 178 |
| thiosalicylic acid | 164 |
| 2-chloro-5-nitrobenzoic acid | 165 |
| 4-methoxyphenol | 53 |
| 2-hydroxybenzyl alcohol | 87 |
| 2,5-dimethylphenol | 75 |
| benzoic acid | 122 |
| o-toluic acid | 107 |
| m-toluic acid | 111 |
| p-toluic acid | 181 |
| o-chlorobenzoic acid | 142 |
| m-hydroxybenzoic acid | 200 |
| 2,4-dihydroxyacetophenone | 97 |
| resorcinol monobenzoate | 135 |
| 4-hydroxybenzophenone | 133 |
| 2,4-dihydroxybenzophenone | 144 |
| 2-naphthoic acid | 184 |
| 1-hydroxy-2-naphthoic acid | 195 |
| 3,4-dihydroxybenzoic acid ethyl ester | 128 |
| 3,4-dihydroxybenzoic acid phenyl ester | 189 |
| 4-hydroxypropiophenone | 150 |
| salicylosalicylate | 148 |

-continued

| | Melting Point (°C.) |
|---|---|
| phthalic acid monobenzyl ester | 107 |

In the present invention, as the coloring agent, phenolic compounds of the following general formula can be employed.

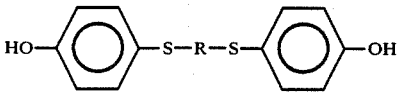

wherein R represents an alkylene group containing 1 to 5 ether bonds. Phenolic compounds of the above formula can be prepared by reacting a monothiohydroquinone with its counterpart dihalogenoalkyl ether in an alkaline atmosphere with high yield and with high purity and at a comparatively low cost.

In the phenolic compounds of the above-mentioned general formula, the ether bonds in the alkylene group can be contained in the main chain of the alkylene group or can be bonded to the side chain of the alkylene group. The number of carbon atoms contained in the alkylene group is usually in the range of 2 to 15 for use in the present invention. Preferably the alkylene group has 1 to 3 ether bonds and the number of carbon atoms contained therein is in the range of 2 to 7.

Specific examples of the phenolic compounds represented by the above general formula are as follows:

| Compound No. | Structural Formula |
|---|---|
| (1) | 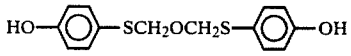 |
| (2) | 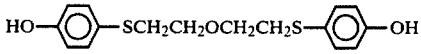 |
| (3) | 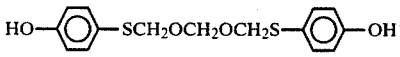 |
| (4) | 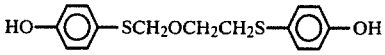 |
| (5) | 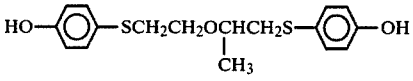 |
| (6) | 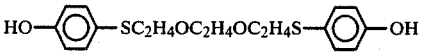 |
| (7) | 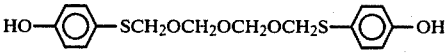 |

-continued

| Compound No. | Structural Formula |
|---|---|
| (8) | 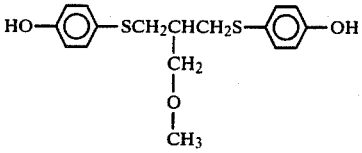 |

The phenolic compounds of the general formula are excellent in thermosensitivity and are suitable for use in high-speed recording thermosensitive image transfer mediums.

As the coloring agent, zinc chloride can also be used. Coloring agents containing zinc chloride are excellent in anti-plasticizer properties and anti-solvent properties and are capable of yielding colored transfer images with high quality.

When the image transfer layer (i.e. the dye layer) and the acceptor layer (i.e. the coloring agent layer) are formed on each support material, the following binder agents can be employed: Water soluble binder agents such as polyvinyl alcohol, methoxy cellulose, hydroxyethyl cellulose, carboxymethyl cellulose, polyvinylpyrrolidone, polyacrylamide, polyacrylic acid, starch and gelatin; and aqueous emulsions of polyethylene, vinyl chloride-vinyl acetate copolymer, and polybutylmethacrylate.

Further in the present invention, a thermo-fusible material with a melting point of not higher than 200° C., preferably not higher than 150° C., can be employed, in the image transfer layer or in the acceptor layer or, if necessary, in both layers. The amount of the thermo-fusible material used is in the range of 0.1 to 50 parts by weight with respect to 1 part by weight of the leuco dye.

Preferable examples of the thermo-fusible material for use in the present invention are as follows:

(1) Fatty acid amides of the following general formula (I) or (II):

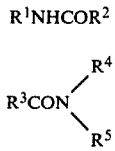

$$R^1NHCOR^2 \quad (I)$$

$$R^3CON\begin{matrix} R^4 \\ R^5 \end{matrix} \quad (II)$$

wherein $R^2$ represents an alkyl group having 1 to 30 carbon atoms, $R^1$ and $R^3$ each represent an alkyl group having 10 to 30 carbon atoms, $R^4$ and $R^5$ independently represent hydrogen or a lower alkyl group.

Specific examples of the above fatty acid amides are as follows:

Decylacetamide,
decylpropionamide,
undecylacetamide,
undecylpropionamide,
laurylacetamide,
laurylpropionamide,
tridecylacetamide,
tridecylpropionamide,
myristylacetamide,
myristylpropionamide, pentadecylacetamide,
pentadecylpropionamide,
palmitylacetamide,
palmitylpropionamide,
palmitylbutylamide,
heptylacetamide,
heptylpropionamide,
stearylacetamide,
stearylpropionamide,
stearylbutylamide,
stearylvaleramide,
stearylcapronamide,
stearyllaurinamide,
stearylpalmitinamide,
stearylstearinamide,
nonadecylacetamide,
nonadecylpropionamide,
behenylacetamide,
behenylpropionamide,
behenylstearinamide,
undecanoic acid methylamide,
undecanoic acid ethylamide,
lauric acid methylamide,
lauric acid ethylamide,
tridecanoic acid methylamide,
tridecanoic acid ethylamide,
myristic acid methylamide,
myristic acid ethylamide,
pentadecanoic acid methylamide,
pentadecanoic acid ethylamide,
palmitic acid methylamide,
palmitic acid dimethylamide,
palmitic acid butylamide,
stearic acid methylamide,
stearic acid ethylamide,
stearic acid propylamide,
stearic acid butylamide,
stearic acid dimethylamide,
stearic acid diethylamide,
stearic acid dibutylamide,
nonadecanoic acid methylamide,
nonadecanoic acid ethylamide,
behenic acid methylamide,
oleic acid methylamide, and
oleic acid ethylamide.

(2) Aromatic carboxylic acid amides represented by the following general formula (III):

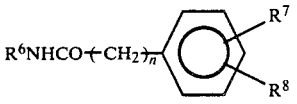

(III)

wherein $R^6$ represents an alkyl group having 1 to 30 carbon atoms, $R^7$ and $R^8$ individually represent hydrogen, halogen, a lower alkyl group or lower alkoxy group, and n is an integer of 0 or 1.

Specific examples of the compounds of the above formula are as follows:
N-stearylbenzamide,
N-palmityl-2-chlorobenzamide,
N-stearyl-2-methoxybenzamide,
N-stearyl-4-methylbenzamide,
N-palmityl-2,4-dimethylbenzamide,
N-behenylbenzamide,
N-behenyl-2-methylbenzamide,
N-stearylphenylacetylamide, and
N-behenylphenylacetylamide.

(3) Amides having cyclohexyl rings represented by the following general formula (IV) or by the following general formula (V)

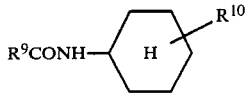

(IV)

wherein $R^9$ represents an alkyl group having 1 to 30 carbon atoms or a substituted or unsubstituted aryl group, and $R^{10}$ represents hydrogen, halogen or a lower alkyl group.

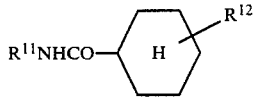

(V)

wherein $R^{11}$ represents an alkyl group having 1 to 30 carbon atoms, and $R^{12}$ represents hydrogen, halogen or a lower alkyl group.

Specific examples of the above compounds are as follows:
N-cyclohexylacetamide,
N-cyclohexylpropionamide,
N-cyclohexylstearic acid amide,
N-cyclohexylbenzamide,
N-cyclohexyl-2-methylbenzamide,
N-cyclohexyl-2-chlorobenzamide,
N-cyclohexyl-2,4-dimethylbenzamide,
N-cyclohexylpalmitic acid amide,
N-(chlorohexyl) palmitic acid amide,
N-(2-methylcyclohexyl) stearic acid amide, and
N-stearylhexahydrobenzamide.

(4) Hydroxybenzoic acid phenyl esters represented by the following general formula (VI):

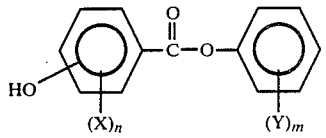

(VI)

wherein X represents halogen, an alkyl group or alkoxy group having 1 to 30 carbon atoms, a substituted or unsubstituted aryl or aralkyl group, a substituted or unsubstituted aryloxy or aralkyloxy group, a carboxylic group or a hydroxide group, n is an integer of 0, 1, 2 or 3, and m is an integer of 1, 2 or 3.

Specific examples of the above compounds are as follows:
4-hydroxybenzoic acid phenyl ester,
4-hydroxybenzoic acid (2-methoxyphenyl) ester,
4-hydroxybenzoic acid (2-methoxy-4-methylphenyl) ester,
4-hydroxybenzoic acid (3,5-dioxyphenyl) ester,
3-hydroxybenzoic acid (4-carboxyphenyl) ester,
4-hydroxybenzoic acid (4-butoxyphenyl) ester,
4-hydroxybenzoic acid (4-chlorophenyl) ester,
salicylic acid (2-chlorophenyl) ester,
salicylic acid (4-chlorophenyl) ester,
salicylic acid (2,3-dichlorophenyl) ester,
salicylic acid (2,6-dichlorophenyl) ester,
salicylic acid (2,4,6-trichlorophenyl) ester, salicylic acid (2-bromophenyl) ester,
salicylic acid (4-bromophenyl) ester,
salicylic acid (2,4-dibromophenyl) ester,
salicylic acid (2,6-dibromophenyl) ester,
salicylic acid (2,4,6-tribromophenyl) ester,
salicylic acid (3-methylphenyl) ester,
salicylic acid (2,4-dimethylphenyl) ester,
salicylic acid (4-tert-butylphenyl) ester,
salicylic acid (4-tert-amylphenyl) ester,
salicylic acid (2-methoxyphenyl) ester,
salicylic acid (2-ethoxyphenyl) ester,
salicylic acid (3-methoxyphenyl) ester,
salicylic acid (4-hydroxyphenyl) ester,
salicylic acid (4-benzylphenyl) ester,
salicylic acid (4-benzoylphenyl) ester,
salicylic acid (2-methoxy-4-arylphenyl) ester,
salicylic acid (α-naphthyl) ester,
salicylic acid (β-naphthyl) ester,
salicylic acid (4-chloro-3-methylphenyl) ester,
salicylic acid (3-hydroxyphenyl) ester,
salicylic acid (4-propenylphenyl) ester,
5-chlorosalicylic acid (3-methylphenyl) ester,
3,5-dichlorosalicylic acid (2-methoxyphenyl) ester.

(5) Benzoic acid phenyl esters represented by the following general formula:

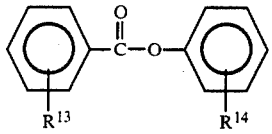

(VII)

wherein $R^{13}$ represents hydrogen, an alkyl group or alkoxy group having 1 to 30 carbon atoms, halogen, a nitro group, nitrile group, an acyloxy group, a substituted or unsubstituted aryl group or aralkyl group, a substituted or unsubstituted aryloxy group or aralkyloxy group, $R^{14}$ represents hydrogen, an alkyl or alkoxyl group having 1 to 30 carbon atoms, halogen, a nitro group, a nitrile group, an acyloxy group, a substituted or unsubstituted aryl or aralkyl group, a substituted or unsubstituted aryloxy group or aralkyloxy group, or an acyl group.

Specific examples of the above compounds are as follows:
Benzoic acid phenyl ester,
benzoic acid-4-methylphenyl ester,
benzoic acid-2,4-dichlorophenyl ester,
benzoic acid-2,4,6-trichlorophenyl ester,
benzoic acid-2-methyl-4-chlorophenyl ester,
benzoic acid-3-bromophenyl ester,
benzoid acid-2,4-dibromophenyl ester,
benzoid acid-3-iodophenyl ester,
benzoic acid-3-nitrophenyl ester,
benzoic acid-4-methyl-2,6-dichlorophenyl ester,
benzoic acid-4-isopropylphenyl ester,
benzoic acid-4-t-butylphenyl ester,
benzoic acid-4-benzylphenyl ester,
benzoic acid-4-(1-naphthyl)phenyl ester,
benzoic acid-2-benzoyloxyphenyl ester,
benzoic acid-4-(2-methyl)diphenyl ester,
benzoic acid-2-phenylethyloxyphenyl ester,
benzoic acid-2-acetoxyphenyl ester,
benzoic acid-4-methoxyphenyl ester,
benzoic acid-4-(4-methyl)phenoxyphenyl ester,
4-methylbenzoic acid phenyl ester,
4-methoxybenzoic acid phenyl ester,
4-phenoxybenzoic acid phenyl ester,
4-acetoxybenzoic acid phenyl ester,
4-methoxybenzoic acid-4-methoxyphenyl ester,
2-acetoxybenzoic acid phenyl ester,
2-benzoyloxybenzoic acid phenyl ester,
2-nitrobenzoic acid-4-methylphenyl ester,
4-nitrobenzoic acid-4-methylphenyl ester,
4-benzoyloxybenzophenone, and
2-benzoyloxy-4-methylbenzophenone.

(6) Benzoyloxybenzoic acid esters represented by the following formula (VIII):

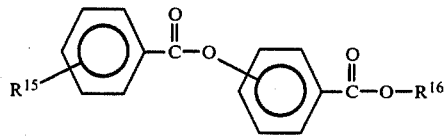

(VIII)

wherein $R^{15}$ represents hydrogen, an alkyl group or alkoxy group having 1 to 30 carbon atoms, or halogen, $R^{16}$ represents an alkyl group having 1 to 30 carbon atoms, or a substituted or unsubstituted aryl or aralkyl group.

Specific examples of the above compounds are as follows:
4-benzoyloxybenzoic acid methyl ester,
4-benzoyloxybenzoic acid ethyl ester,
4-benzoyloxybenzoic acid-n-propyl ester,
4-benzoyloxybenzoic acid benzyl ester,
4-benzoyloxybenzoic acid phenyl ester,
2-benzoyloxybenzoic acid phenyl ester,
4-(4'-methylbenzoyloxy)benzoic acid ethyl ester,
4-(4'-methoxybenzoyloxy)benzoic acid ethyl ester,
4-(4'-chlorobenzoyloxy)benzoic acid ethyl ester.

In the present invention, in order to obtain a thermosensitive image transfer medium with high thermosensitivity, it is effective to subject the image transfer layer and/or the acceptor layer, either of which contains the previously described thermo-fusible materials, to heat treatment at temperatures above the melting points of the thermo-fusible materials during or after the formation of those layers so as to melt the thermo-fusible materials once within the layers. When the image transfer layer containing the leuco dye is formed, it is preferable to use a coating liquid in which the leuco dye is dissolved. Furthermore, it is preferable that the surface of the image transfer layer and/or of the acceptor layer be made smooth to the extent ranging from 200 to 1,000 seconds in terms of Bekk's smoothness which is measured in accordance with the Japanese Industrial Standard P 8119.

The thermosensitive image transfer medium according to the present invention can be prepared by dispersing or dissolving the above described components for each layer together with a solvent such as water in a ball mill or in an attritor to prepare each layer formation liquid and by applying each layer formation liquid to each support material in an amount ranging from 0.3 to 30 g/m$^2$ (when dried).

In the image transfer sheet for use in the present invention, the image transfer layer can be formed uniformly on the entire surface of the support material or only in the necessary portions in an image-like form on the support material. When the image transfer layer is formed uniformly on the entire surface of the support material, it can be formed simply by coating the image transfer layer formation liquid uniformly on the support material. The image transfer sheet having an image-like image transfer layer can be prepared by coating the image formation liquid on the surface of the support material by anastatic printing or by photogravure. Alternatively the image transfer sheet having an image-like image transfer layer can be prepared by superimposing the transfer sheet having the image transfer layer of the entire surface thereof on an appropriate support material such as paper, synthetic paper, or plastic film and applying pressure in an image-like manner from the backside of the support material or from the backside of the image transfer sheet by use of pressure application means such as a typewriter or a steel pen or by use of heat application means such as a thermal head or thermal pen, thereby the image transfer layer is transferred in the form of image-like patterns from the image transfer sheet to the surface of the support material.

When thermal image transfer is conducted in the present invention, for example, by use of the image transfer sheet having the image-like image transfer layer, an acceptor sheet is superimposed on the surface of the image transfer layer, and the image transfer sheet and the acceptor sheet are caused to pass, for instance, between a pair of heat application rollers. When the image transfer sheet with the image transfer layer on the entire surface thereof is used, the acceptor sheet is superimposed on the image transfer sheet in such a manner that the acceptor layer is in close contact with the image transfer layer of the image transfer sheet, and direct thermal printing is conducted by use of a thermal printer from the backside of the image transfer sheet, or the acceptor sheet is superimposed on the image transfer sheet in the above-mentioned manner and a transparent original sheet having images written in black ink is further superimposed closely on the backside of the image transfer sheet and infrared rays are projected to the acceptor sheet, so that the black image portions of the original sheet are selectively heated to a high temperature, thus thermal image transfer is conducted corresponding to the images of the original sheet. In this case, it is necessary that the image transfer sheet and the acceptor sheet be transparent to infrared rays.

In the thermosensitive image transfer in the present invention, a number of copies can be made with ease by repeating the above described operation, using the same image transfer sheet. When making copies with multiple colors, a plurality of image transfer sheets, each of which contains a leuco dye, a different color from the colors of other leuco dyes, are prepared, for instance, an image transfer sheet containing a leuco dye which can be colored blue and another image transfer sheet containing a leuco dye which can be colored red are prepared. By superimposing those image transfer sheets successively on the same acceptor sheet, blue and red images can be formed on the same acceptor sheet.

In the present invention, the leuco dye and the coloring agent which induces color formation in the leuco dye are separately supported on different support materials. Therefore, no color fogging occurs during the preparation of the thermosensitive image transfer medium and the storage thereof, unlike the conventional thermosensitive sheets.

Further, in the copies made by the present invention, no leuco dye is present in the non-image areas of the copy sheets, and only the coloring agent is present. Therefore, even if the copy sheet happens to be heated, no further coloring takes place. In other words, in the copies obtained by the present invention, image fixing is perfect. In addition to the above-mentioned advantage of the present invention, images with high density can be obtained by use of a small amount of thermal energy, and a number of copies can be made from one image transfer sheet, and images formed on those copies are uniform in image density because a constant amount of the leuco dye is transferred from the image transfer layer of the image transfer sheet to the acceptor layer of the acceptor sheet during each image transfer step.

EXAMPLE 1

Preparation of Image Transfer Sheet A-1

The following components were dispersed in a ball mill for 24 hours to prepare an image transfer layer formation liquid. The thus prepared image transfer layer formation liquid was applied by a wire bar to a polyester film with a thickness of 12 μm whose surface was treated so as to be rough, with a deposition of the above solid components thereof in an amount of 10 g/m$^2$ when dried, whereby an image transfer sheet A-1 was prepared.

| | |
|---|---|
| Carnauba Wax | 10 g |
| Crystal Violet Lactone | 20 g |
| Ethyl cellulose | 5 g |
| Water | 100 g |

Preparation of Acceptor Sheet B-1

The following components were dispersed in a ball mill for 24 hours to prepare an acceptor layer formation liquid. The thus prepared acceptor layer formation liquid was applied to a sheet of high quality paper (35 g/m$^2$) by a wire bar, with a deposition of the solid components thereof in an amount of 5 g/m$^2$ when dried, whereby an acceptor sheet B-1 was prepared.

| | |
|---|---|
| 4-hydroxybenzoic acid n-butyl ester | 20 g |
| Silica particles (with an oil absorption 200 ml/100 g) | 10 g |
| Polyvinyl alcohol | 3 g |
| Water | 100 g |

The image transfer sheet A-1 was superimposed on the acceptor sheet B-1 in such a manner that the image transfer layer of the image transfer sheet A-1 was in close contact with the acceptor layer of the acceptor sheet B-1, and 3 mm Joule of thermal energy was applied through a thermal head to the backside of the image transfer sheet A-1. As a result, blue images were formed on the acceptor sheet B-1. The image density of the thus obtained blue images was measured by use of a Macbeth densitometer (RD-514). The result is shown in Table 1.

From the above image transfer sheet A-1, 20 copies were made using 20 new acceptor sheets B1 successively. The transferred images were almost the same in image density in the first copy through the 20th copy.

EXAMPLE 2

In the formulation of the acceptor sheet B-1 in Example 1, the silica particles were replaced by a urea-formaldehyde resin (with an oil absorption of 250 ml/100 g), so that an acceptor sheet B-2 was prepared.

By use of the thus prepared acceptor sheet B-2 and the image transfer sheet A-1 prepared in Example 1, image formation was carried out in the same manner as in Example 1. As a result, blue images were formed on the acceptor sheet B-2. The image density of the blue images was measured by the Macbeth densitometer in the same manner as in Example 1. The result is shown in Table 1.

COMPARATIVE EXAMPLE 1

From the formulation of the acceptor sheet B-1 in Example 1, the silica particles were removed, whereby a comparative acceptor sheet CB-1 was prepared.

By use of the thus prepared comparative acceptor sheet CB-1 and the image transfer sheet A-1 prepared in Example 1, image formation was carried out in the same manner as in Example 1. As a result, blue images were formed on the comparative acceptor sheet CB-1. The image density of the blue images was measured by the Macbeth densitometer in the same manner as in Example 1. The result is shown in Table 1.

COMPARATIVE EXAMPLE 2

In the formulation of the acceptor sheet B-1 in Example 1, the silica particles were replaced by calcium carbonate particles with an oil absorption of 30 ml/100 g, whereby a comparative acceptor sheet CB-2 was prepared.

By use of the thus prepared comparative acceptor sheet CB-2 and the image transfer sheet A-1 prepared in Example 1, image formation was carried out in the same manner as in Example 1. As a result, blue images were formed on the comparative acceptor sheet CB-2. The image density of the blue images was measured by the Macbeth densitometer in the same manner as in Example 1. The result is shown in Table 1.

TABLE 1

| | Image Transfer Sheet | Acceptor Sheet | Image Density |
|---|---|---|---|
| Example 1 | A-1 | B-1 | 1.09 |
| Example 2 | A-1 | B-2 | 1.10 |
| Comparative Example 1 | A-1 | CB-1 | 0.43 |
| Comparative Example 2 | A-1 | CB-2 | 0.54 |

As can be seen from the results shown in Table 1, the thermosensitive image mediums according to the present invention provided higher image densities than the comparative examples did.

EXAMPLE 3

In the formulation of the image transfer sheet A-1, Crystal Violet Lactone was replaced by 3-diethylamino-6-chlorofluoran, whereby an image transfer sheet A-2 for formation of red images was prepared.

The thus prepared image transfer sheet A-2 was superimposed on the acceptor sheet B-1 with a blue image formed thereon by the same procedure as in Examplel, so that the image transfer layer of the image transfer sheet A-2 was brought into close contact with the acceptor layer of the acceptor sheet B-1. As in Example 1, 3 mm Joule of thermal energy was applied through a thermal head to the backside of the image transfer sheet. As a result, a clear red image was formed on the acceptor sheet B-1. Consequently, the red image and the blue image were formed on the acceptor sheet B-1.

EXAMPLE 4

Preparation of the Image Transfer Sheet A-3

The following components were dispersed in a ball mill for 24 hours to prepared an image transfer layer formation liquid. The thus prepared image transfer layer formation liquid was applied by a wire bar to a polyester film with a thickness of 12 μm whose surface was treated so as to be rough, with a deposition of the solid components thereof in an amount of 10 g/m$^2$ when dried, whereby an image transfer sheet A-3 was prepared.

| | |
|---|---|
| Carnauba wax | 10 g |
| Crystal Violet Lactone | 20 g |
| Silica particles (with an oil absorption of 300 ml/100 g) | 1 g |
| Ethyl cellulose | 5 g |
| Water | 100 g |

This image transfer sheet was superimposed on the acceptor sheet B-1 prepared in Example 1 in such a manner that the image-transfer layer of the image transfer sheet A-3 was in close contact with the acceptor layer of the acceptor sheet B-1, and 3 mm Joule of thermal energy was applied through a thermal head to the backside of the image transfer sheet A-3. As a result, blue images were formed on the acceptor sheet B-1. The image density of the thus obtained blue images was measured by use of the Macbeth densitometer (RD-514) employed in Example 1. The result is shown in Table 2.

From the above image transfer sheet A-3, 30 copies were made by using 30 new acceptor sheets B-1 successively. The image densities obtained in those copies are shown in Table 2.

EXAMPLE 5

In the formulation of the image transfer sheet A-3 in Example 4, the amount of the silica particles was increased to 5 g, so that an image transfer sheet A-4 was prepared. By use of the thus prepared image transfer sheet A-4 and the acceptor sheet B-1 prepared in Example 1, image formation was carried out in the same manner as in Example 1. As a result, blue images were formed on the acceptor sheet B-1. The image density of the blue images was measured by the Macbeth densitometer in the same manner as in Example 1. The results is shown in Table 2.

From the above image transfer sheet A-4, 30 copies were made by using 30 new acceptor sheets B-1 successively. The image densities obtained in those copies are also shown in Table 2.

EXAMPLE 6

In the formulation of the image transfer sheet A-3 in Example 4, the amount of the silica particles was increased to 10 g, so that an image transfer sheet A-5 was prepared. By use of the thus prepared image transfer sheet A-5 and the acceptor sheet B-1 prepared in Example 1, image formation was carried out in the same manner as in Example 1. As a result, blue images were formed on the acceptor sheet B-1. The image density of the blue images was measured by the Macbeth densitometer in the same manner as in Example 1. The result is shown in Table 2.

From the above image transfer sheet A-5, 30 copies were made by using 30 new acceptor sheets B-1 successively. The image densities obtained in those copies are also shown in Table 2.

EXAMPLE 7

In the formulation of the image transfer sheet A-3 in Example 4, the silica particles were replaced by a urea-formaldehyde resin (with an oil absorption of 250 ml/100 g), whereby an image transfer sheet A-6 was prepared. By use of the thus prepared image transfer sheet A-6 and the acceptor sheet B-1 prepared in Example 1, image formation was carried out in the same manner as in Example 1. As a result, blue images were formed on the acceptor sheet B-1. The image density of the blue images was measured by the Macbeth densitometer in the same manner as in Example 1. The result is shown in Table 2.

From the above image transfer sheet A-6, 30 copies were made by using 30 new acceptor sheets B-1 successively. The image densities obtained in those copies are also shown in Table 2.

COMPARATIVE EXAMPLE 3

From the formulation of the image transfer sheet A-3 in Example 4, the silica particles were removed, so that a comparative image transfer sheet CA-1 was prepared.

By use of the thus prepared comparative image transfer sheet CA-1 and the acceptor sheet B-1 prepared in Example 1, image formation was carried out in the same manner as in Example 1. As a result, blue images were formed on the comparative acceptor sheet B-1. The image density of the blue images was measured by the Macbeth densitometer in the same manner as in Example 1. The result is shown in Table 2.

From the above comparative image transfer sheet CA-1, 30 copies were made by using 30 new acceptor sheets B-1 successively. The image densities obtained in those copies are shown in Table 2.

TABLE 2

| | Image Transfer Sheet | Acceptor Sheet | Image Density No. of Image Transfers | | | |
|---|---|---|---|---|---|---|
| | | | 1 | 10 | 20 | 30 |
| Example 4 | A-3 | B-1 | 1.00 | 0.97 | 0.98 | 0.96 |
| Example 5 | A-4 | B-1 | 0.97 | 0.98 | 0.98 | 0.99 |
| Example 6 | A-5 | B-1 | 0.95 | 0.97 | 0.98 | 0.97 |
| Example 7 | A-6 | B-1 | 0.83 | 0.85 | 0.84 | 0.85 |
| Comparative Example 3 | CA-1 | B-1 | 1.05 | 0.42 | 0.35 | 0.30 |

EXAMPLE 8

Preparation of Image Transfer Sheet A-7

The following components were dispersed in a ball mill for 24 hours to prepare an image transfer layer formation liquid. The thus prepared image transfer layer formation liquid was applied by a wire bar to a polyester film with a thickness of 12 μm whose surface was treated so as to be rough, with a deposition of the solid components thereof in an amount of 10 g/m$^2$ when dried, whereby an image transfer sheet A-7 was prepared.

| | |
|---|---|
| Carnauba wax | 10 g |
| 3-N—methyl-N—cyclohexylamino-6-methyl-7-anilinofluoran | 20 g |
| Silica particles (with an oil absorption of 300 ml/100 g) | 1 g |
| Ethyl cellulose | 5 g |
| Water | 100 g |

This image transfer sheet was superimposed on the acceptor sheet B-1 prepared in Example 1 in such a manner that the image transfer layer of the image transfer sheet A-7 was in close contact with the acceptor layer of the acceptor sheet B-1, and 1 mm Joule of thermal energy was applied through a thermal head to the backside of the image transfer sheet A-7. As a result, black images were formed on the acceptor sheet B-1. The image density of the thus obtained blue images was measured by use of the Macbeth densitometer (RD-514). The result is shown in Table 3.

From the above image transfer sheet A-7, 30 copies were made by using 30 new acceptor sheets B-1 successively. The image densities obtained in those copies are also shown in Table 3.

EXAMPLE 9

In the formulation of the image transfer sheet A-7 in Example 8, the amount of the silica particles was increased to 5 g, whereby an image transfer sheet A-8 was prepared. By use of the thus prepared image transfer sheet A-8 and the acceptor sheet B-1 prepared in Example 1, image formation was carried out in the same manner as in Example 1. As a result, black images were formed on the acceptor sheet B-1. The image density of the black images was measured by the Macbeth densitometer. The result is shown in Table 3.

From the above image transfer sheet A-8, 30 copies were made by using 30 new acceptor sheets B-1 successively. The image densities obtained in those copies are also shown in Table 3.

EXAMPLE 10

In the formulation of the image transfer sheet A-7 in Example 8, the amount of the silica particles was increased to 10 g, whereby an image transfer sheet A-9 was prepared. By use of the thus prepared image transfer sheet A-9 and the acceptor sheet B-1 prepared in Example 1, image formation was carried out in the same manner as in Example 1. As a result, black images were formed on the acceptor sheet B-1. The image density of the black imges was measured by the Macbeth densitometer. The result is shown in Table 3.

From the above image transfer sheet A-9, 30 copies were made by using 30 new acceptor sheets B-1 successively. The image densities obtained in those copies are also shown in Table 3.

COMPARATIVE EXAMPLE 4

In the formulation of the image transfer sheet A-7 in Example 8, the silica particles were replaced by calcium carbonate particles with an oil absorption of 35 ml/100 g, whereby a comparative image transfer sheet CA-2 was prepared.

By use of the thus prepared comparative image transfer sheet CA-2 and the image acceptor sheet B-1 prepared in Example 1, image formation was carried out in the same manner as in Example 1. As a result, black images were formed on the acceptor sheet B-1. The image density of the black images was measured by the Macbeth densitometer. The result is shown in Table 3.

From the above comparative image transfer sheet CA-2, 30 copies were made by using 30 new acceptor sheets B-1 successively. The image densities obtained in those copies are also shown in Table 3.

TABLE 3

| | Image Transfer Sheet | Acceptor Sheet | Image Density No. of Image Transfers 1 | 10 | 20 | 30 |
|---|---|---|---|---|---|---|
| Example 8 | A-7 | B-1 | 1.15 | 1.13 | 1.12 | 1.13 |
| Example 9 | A-8 | B-1 | 1.10 | 1.11 | 1.12 | 1.13 |
| Example 10 | A-9 | B-1 | 1.06 | 1.08 | 1.08 | 1.05 |
| Comparative Example 4 | CA-2 | B-1 | 1.13 | 0.52 | 0.35 | 0.29 |

As can be seen from the results shown in Table 1, the thermosensitive image mediums according to the present invention provided higher image densities than the comparative example did.

What is claimed is:

1. A thermosensitive image transfer medium comprising:

an image transfer sheet having an image transfer layer comprising a leuco dye; and an acceptor sheet having an acceptor layer comprising a coloring agent which induces color formation in said leuco dye, and, at least one of said image transfer layer and said acceptor layer, further contains a porous filler having an oil absorption of 50 ml/100 g or more as measured in accordance with the Japanese Industrial Standard K 5101.

2. A thermosensitive image transfer medium as claimed in claim 1, wherein the amount of said porous filler is in the range of 0.01 part by weight to 1.0 part by weight with respect to 1 part of said leuco dye when said porous filler is contained in said image transfer sheet.

3. A thermosensitive image transfer medium as claimed in claim 1, wherein the amount of said porous filler is at least 0.01 part by weight with respect to 1 part by weight of said coloring agent when said porous filler is contained in said acceptor layer.

4. A thermosensitive image transfer medium as claimed in claim 1, wherein said filler is selected from the group consisting of silica, aluminum silicate, alumina, aluminum hydroxide, magnesium hydroxide, urea-formaldehyde resin and styrene resin.

5. A thermosensitive image transfer medium as claimed in claim 1, wherein the melting point of said leuco dye is not higher than 200° C.

6. A thermosensitive image transfer medium as claimed in claim 1, wherein said leuco dye is selected from the group consisting of triphenylmethane-type leuco dyes, fluoran-type leuco dyes, phenothiazine-type leuco dyes, auramine-type leuco dyes and spiropyran-type leuco dyes.

7. A thermosensitive image transfer medium as claimed in claim 1, wherein said coloring agent is an electron acceptor material.

8. A thermosensitive image transfer medium as claimed in claim 7, wherein said electron acceptor material is selected from the group consisting of phenolic materials, organic carboxylic acid materials, and salts and esters of said organic carboxylic acid materials, with the melting points thereof being not higher than 200° C.

9. A thermosensitive image transfer medium as claimed in claim 8, wherein said phenolic materials are represented by the formula of

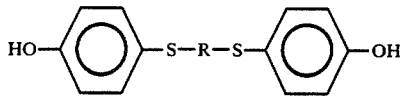

wherein R is an alkylene group containing 1 to 5 ether bonds.

10. A thermosensitive image transfer medium as claimed in claim 1, wherein said image transfer sheet and said acceptor sheet each comprise a support material on which said image transfer layer and said acceptor layer are respectively supported.

11. A thermosensitive image transfer medium as claimed in claim 10, wherein the coating amount of said leuco dye on said support material is in the range of 0.3 $g/m^2$ to 30 $g/m^2$.

12. A thermosensitive image transfer medium as claimed in claim 1, wherein said coloring agent comprises zinc chloride.

13. A thermosensitive image transfer medium as claimed in claim 1, wherein at least one of said image transfer layer and said acceptor layer contains a thermofusible material with a melting point of not higher than 200° C.

14. A thermosensitive image transfer medium as claimed in claim 13, wherein said thermo-fusible material is selected from the group consisting of the fatty acid amides of the general formula (I) and the fatty acid amides of the general formula (II):

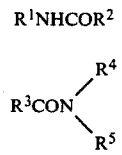

wherein $R^2$ represents an alkyl group having 1 to 30 carbon atoms, $R^1$ and $R^3$ each represents an alkyl group having 10 to 30 carbons atoms, $R^4$ and $R^5$ independently represent hydrogen or a lower alkyl group.

15. A thermosensitive image transfer medium as claimed in claim 13, wherein said thermo-fusible material is selected from the group consisting of the aromatic carboxylic acid amides of the general formula (III):

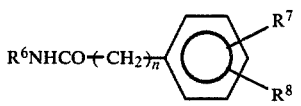

wherein $R^6$ represents an alkyl group having 1 to 30 carbon atoms, $R^7$ and $R^8$ individually represent hydrogen, halogen, a lower alkyl group or a lower alkoxy group, and n is an integer of 0 or 1.

16. A thermosensitive image transfer medium as claimed in claim 13, wherein said thermo-fusible material is selected from the group consisting of the amides having cyclohexyl rings of the general formula (IV) and the amides having cyclohexyl rings of the general formula (V)

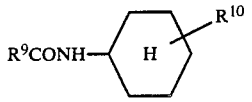

(IV)

wherein $R^9$ represents an alkyl group having 1 to 30 carbon atoms or a substituted or unsubstituted aryl group, and $R^{10}$ represents hydrogen, halogen or a lower alkyl group

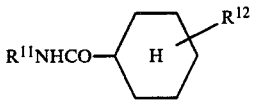

(V)

wherein $R^{11}$ represents an alkyl group having 1 to 30 carbon atoms, and $R^{12}$ represents hydrogen, halogen or a lower alkyl group.

17. A thermosensitive image transfer medium as claimed in claim 13, wherein said thermo-fusible material is selected from the group consisting of the hydroxybenzoic acid phenyl esters of the general formula (VI):

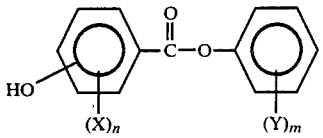

(VI)

wherein X represents halogen, an alkyl group or alkoxy group having 1 to 30 carbon atoms, a substituted or unsubstituted aryl or aralkyl group, a substituted or unsubstituted aryloxy or aralkyloxy group, a carboxylic group or a hydroxyl group, n is an integer of 0, 1, 2 or 3, and m is an integer of 1, 2 or 3.

18. A thermosensitive image transfer medium as claimed in claim 13, wherein said thermo-fusible material is selected from the group consisting of the benzoic acid phenyl esters of the general formula (VII):

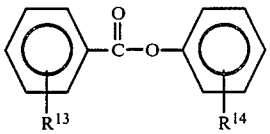

(VII)

wherein $R^{13}$ represents hydrogen, an alkyl group or alkoxy group having 1 to 30 carbon atoms, halogen, a nitro group, nitrile group, an acyloxy group, a substituted or unsubstituted aryl group or aralkyl group, a substituted or unsubstituted aryloxy group or aralkyloxy group, $R^{14}$ represents halogen, an alkyl or alkoxy group having 1 to 30 carbon atoms, halogen, a nitro group, a nitrile group, an acyloxy group, a substituted or unsubstituted aryl or aralkyl group, a substituted or unsubstituted aryloxy group or aralkyloxy group, or an acyl group.

19. A thermosensitive image transfer medium as claimed in claim 13, wherein said thermo-fusible material is selected from the group consisting of the benzoyloxybenzoic acid esters of the formula (VIII):

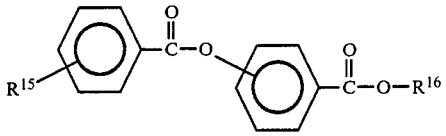

(VIII)

wherein $R^{15}$ represents hydrogen, an alkyl group or alkoxy group having 1 to 30 carbon atoms, or halogen, $R^{16}$ represents an alkyl group having 1 to 30 carbon atoms, or a substituted or unsubstituted aryl or aralkyl group.

20. A thermosensitive image transfer medium as claimed in claim 1, wherein the smoothness of the surface of at least one layer of said image transfer layer and said acceptor layer is in the range of 200 seconds to 1,000 seconds in terms of Bekk's smoothness.

21. A thermosensitive image transfer medium as claimed in claim 1, wherein both said image transfer sheet and said image acceptor sheet are transparent to infrared rays.

22. A thermosensitive image transfer medium, comprising: an image transfer sheet comprising a first support having an image transfer layer thereon; an acceptor sheet separate from said image transfer sheet and comprising a second support having an acceptor layer thereon; said image transfer layer consisting essentially of (a) from 0.3 to 30 grams of leuco dye per square meter of said first support, (b) from 0.1 to 1 parts by weight of porous filler particles per 1 part by weight of said leuco dye, and (c) first binder agent, said porous filler particles having an oil absorption of 50 ml/100 g or higher as measured in accordance with Japanese Industrial Standard K 5101; said acceptor layer consisting essentially of (d) coloring agent having a melting point not higher than 200° C. and which, when said acceptor layer is heated while in contact with said image transfer layer, can react with said leuco dye to color said dye, (e) from 0.05 to 10 parts by weight of said porous filler particles per 1 part by weight of said coloring agent, and (f) second binder agent, whereby when an assembly is formed of said acceptor sheet with said image transfer sheet in which said acceptor layer is in face-to-face contact with said image transfer layer and heat is applied in an imagewise pattern on either said first support or said second support, there will occur imagewise transfer of small amounts of said leuco dye from said image transfer layer to said acceptor layer and a color-forming reaction will occur in said acceptor layer to form a corresponding image on said acceptor layer, said acceptor sheet then being separable from said image transfer sheet to provide a copied image and said image transfer sheet being capable of repeated use with other like acceptor sheets.

* * * * *

UNITED STATES PATENT AND TRADEMARK OFFICE

CERTIFICATE OF CORRECTION

PATENT NO. : 4 547 788

DATED : October 15, 1985

INVENTOR(S) : Norio Kurisu et al

It is certified that error appears in the above-identified patent and that said Letters Patent is hereby corrected as shown below:

Column 19, line 59; change "$R^{14}$ represents halogen," to ---$R^{14}$ represents hydrogen,---.

Signed and Sealed this

*Eighth* Day of *April 1986*

[SEAL]

*Attest:*

DONALD J. QUIGG

*Attesting Officer*

*Commissioner of Patents and Trademarks*